US010763619B1

(12) United States Patent
Zhu

(10) Patent No.: US 10,763,619 B1
(45) Date of Patent: Sep. 1, 2020

(54) LOCKING ELECTRICAL CONNECTOR, LOCKING METHOD AND DEVICE

(71) Applicant: Xiaoping Zhu, Dongguan (CN)

(72) Inventor: Xiaoping Zhu, Dongguan (CN)

( * ) Notice: Subject to any disclaimer, the term of this patent is extended or adjusted under 35 U.S.C. 154(b) by 0 days.

(21) Appl. No.: 16/436,983

(22) Filed: Jun. 11, 2019

(51) Int. Cl.

| | |
|---|---|
| ***H01R 13/639*** | (2006.01) |
| ***H01R 13/642*** | (2006.01) |
| ***H01R 13/502*** | (2006.01) |
| ***H01R 13/514*** | (2006.01) |
| ***H01R 13/629*** | (2006.01) |
| ***H01R 24/00*** | (2011.01) |

(52) U.S. Cl.
CPC ..... *H01R 13/639* (2013.01); *H01R 13/502* (2013.01); *H01R 13/514* (2013.01); *H01R 13/629* (2013.01); *H01R 13/642* (2013.01); *H01R 24/00* (2013.01)

(58) Field of Classification Search
CPC .. H01R 13/639; H01R 13/502; H01R 13/514; H01R 13/629; H01R 13/642; H01R 24/00; H01R 13/6215; H01R 13/62933; H01R 13/62938; H01R 13/6271; H01R 13/6275
USPC ..... 439/345, 352, 357–359, 372
See application file for complete search history.

(56) References Cited

U.S. PATENT DOCUMENTS

| | | | | |
|---|---|---|---|---|
| 3,240,520 A * | 3/1966 | Dailey | B64D 1/02 | 403/325 |
| 4,919,627 A * | 4/1990 | Cable | H01R 39/64 | 439/180 |
| 5,131,705 A * | 7/1992 | Gluck | B66C 1/66 | 294/82.32 |
| 7,396,250 B1 * | 7/2008 | Huang | H01R 13/506 | 439/351 |
| 8,840,417 B2 * | 9/2014 | Chang | H01R 13/6395 | 439/345 |
| 2009/0149051 A1 * | 6/2009 | Deng | H01R 13/6392 | 439/345 |
| 2013/0065418 A1 * | 3/2013 | Evans | H01R 9/05 | 439/345 |
| 2019/0273332 A1 * | 9/2019 | Youtsey | H01R 13/641 | |

* cited by examiner

*Primary Examiner* — Travis S Chambers
(74) *Attorney, Agent, or Firm* — HYIP

(57) ABSTRACT

The present disclosure provides a locking electrical connector for electrical connection with an outlet connector. The adapter outlet connector includes a first housing, the locking electrical connector includes a second housing, an actuating assembly, and a locking member. At least one electrical connection point enclosing in the second housing, which can be electrically connected to the outlet connector. The locking member is rotatably fixed to the second housing and capable of being driven by the actuating assembly, so as to rotate relative to the second housing, such that the locking member is frictionally locked with the side surface of the first housing, thereby enabling the locking electrical connector to be electrically locked with the outlet connector. The present disclosure can better prevent the electrical connection from failing and loosening.

12 Claims, 7 Drawing Sheets

LOCKING ELECTRICAL CONNECTOR, LOCKING METHOD AND DEVICE

TECHNICAL FILED

The present disclosure relates to a technical filed of the connector, in particular to a locking electrical connector, locking method and device.

BACKGROUND

Connectors are widely used and generally include plugs and sockets. The plug is a male head, and an inserted pin is arranged thereon. The socket is used as a female head, and a contact pin is arranged therein. The inserted pin can be inserted into the socket to make electrical contact with the contact pin in the socket to realize electrical conduction between the power source and the electric device. When the plug and the socket are connected, it is easy to separate the two due to external factors, resulting in failure of the electrical connection, which may cause serious consequences.

SUMMARY OF THE DISCLOSURE

In order to ensure the effectiveness of the electrical connection, the present disclosure provides a locking electrical connector that is capable of locking the connector between the connectors in a relatively reliable and simple manner to better prevent electrical connection failure.

A first aspect of the present disclosure provides a locking electrical connector, configured to electrically connect to an outlet connector. The outlet connector having a first housing, the locking electrical connector includes a second housing, an actuating assembly and a locking member. At least one electrical connection point being electrically connectable to the outlet connector is received in the second housing. A locking member is rotatably fixed to the second housing and is driven by the actuating assembly, so as to rotate relative to the second housing, such that the locking member is frictionally locked with the side surface of the first housing, to realize lock of the electrical connection between the locking electrical connector and the outlet connector.

A second aspect of the present disclosure provides a locking method for locking an electrical connector, which is for locking electrically connection between a locking electrical connector and an outlet connector, wherein the outlet electrical connector having a first housing, the method including:

providing a second housing and an actuating assembly, the second housing having at least one electrical connection point that is electrically connectable to the outlet connector; and providing a locking member, wherein the locking member is rotatably fixed to the second housing and is driven by the actuating assembly, so as to rotate relative to the second housing, such that the locking member is frictionally locked with the side surface of the first housing, to realize lock of the electrical connection between the locking electrical connector and the outlet connector;

operating the actuating assembly to rotate the locking member until the locking electrical connector is engageable with the outlet connector and to achieve an electrical connection;

operating the actuating assembly to rotate the locking member until the locking member is frictionally locked with the side surface of the first housing.

The advantageous effects of the present disclosure are as following: in the present disclosure, the locking member is driven to rotate by the actuating assembly, and during the rotation, the pressure between the locking member and the housing of the outlet connector is gradually increased, so that the frictional force is gradually increased, thereby the locking electrical connector is locked together with the outlet connector, reducing the electrical connection failure caused by accidental disconnection.

DETAILED DESCRIPTION OF THE EMBODIMENTS

The technical solutions in the embodiments of the present disclosure will be clearly and completely described in the following with reference to the accompanying drawings in the embodiments of the present disclosure. It is obvious that the described embodiments are only a part of the embodiments of the present disclosure, but not all embodiments. All other embodiments obtained by those skilled in the art based on the embodiments of the present disclosure without creative efforts are within the scope of the present disclosure. It should be understood that the accompanying drawings are not intended to limit the present disclosure, but merely providing a reference and description. The connection relationships shown in the accompanying drawings are for convenience of clarity and do not limit the connection.

Figure 1:
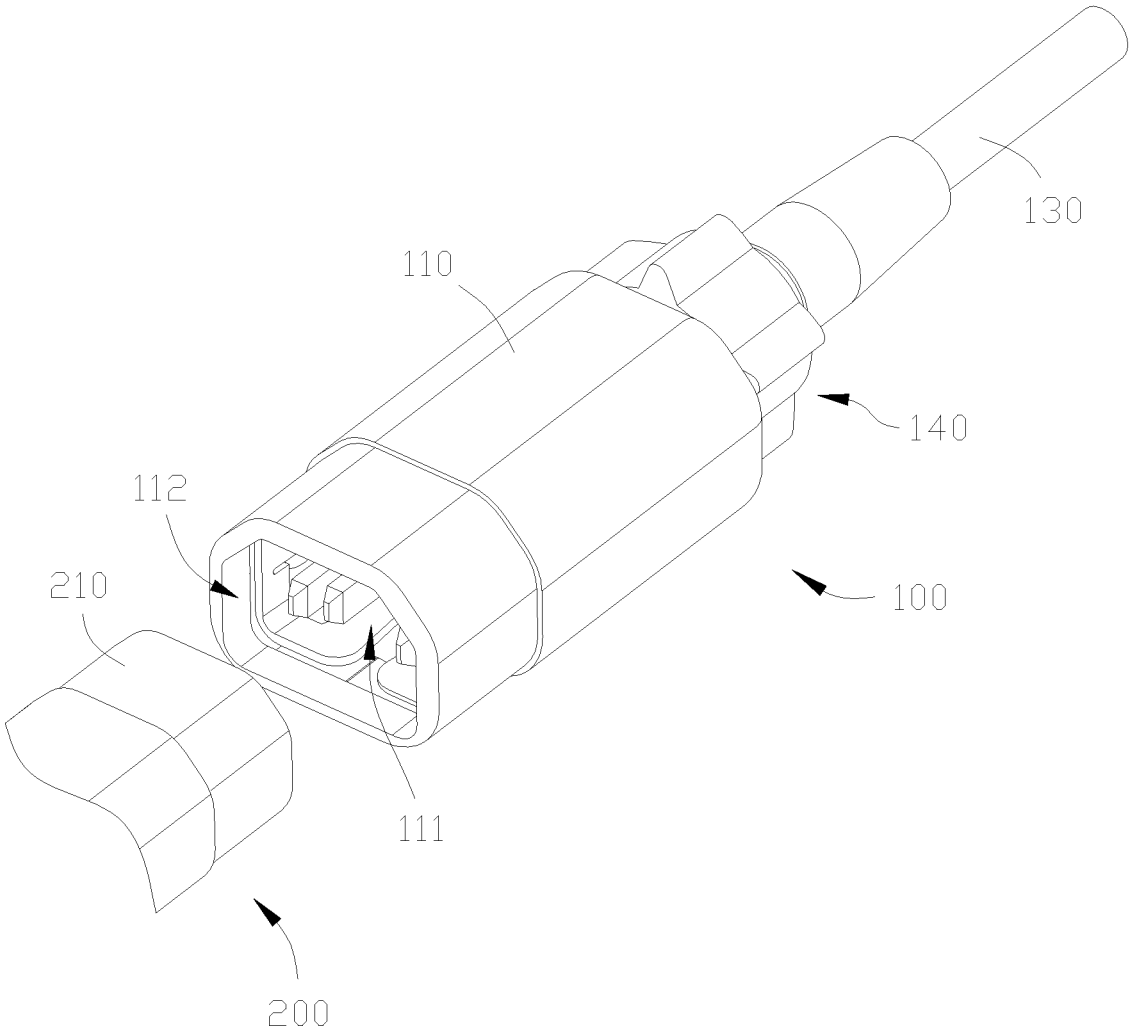
FIG. 1 is a schematic structural view of a locking electrical connector according to an embodiment of the present disclosure.

FIG. 1 is a schematic structural view of a locking electrical connector 100 according to an embodiment of the present disclosure. As shown in FIG. 1, the locking electrical connector 100 of FIG. 1 is a male plug that can be electrically connected to a corresponding outlet connector 200 to realize electrical conduction. The outlet connector 200 is a female socket, and includes a first housing 210 and an inserted pin fixed inside the first housing 210. The locking electrical connector 100 includes a second housing 110 and a locking assembly 140. It should be understood that the locking electrical connector 100 can also be a female socket while the outlet connector 200 is connected as a male plug.

Figure 2:
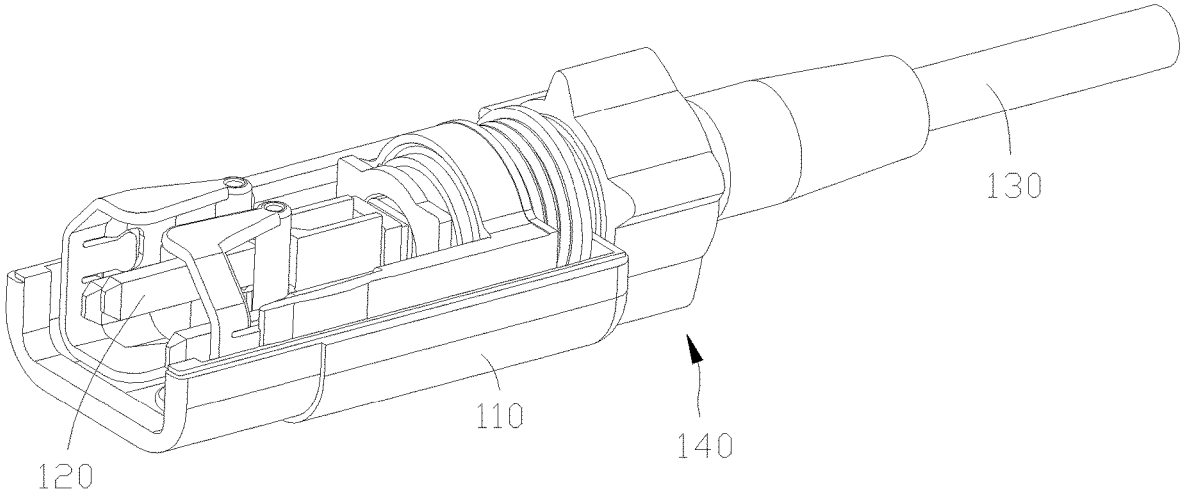
FIG. 2 is a schematic structural view of the locking electrical connector after a part of the housing is taken out according to an embodiment of the present disclosure.

As shown in FIG. 2, the second housing 110 includes a receiving cavity 111, and the cross-sectional profile of the receiving cavity 111 is substantially the same as the cross-sectional profile of the first housing 210. An inserted pin 120 is fixed in the receiving cavity 111, and an insertion opening 112 for inserting the first housing 210 into the receiving cavity 111 is opened and formed at the insertion end. A cable 130 is connected to the tail end of the second housing 110 opposite to insertion end. The cable 130 extends into the second housing 110 and electrically connects the inserted pin. The number and/or position and/or angle of the inserted pin 120 can be set according to different standards. When the first housing 210 is inserted into the second housing 110, the cable 130 is in electrical contact with pins.

Figure 3:
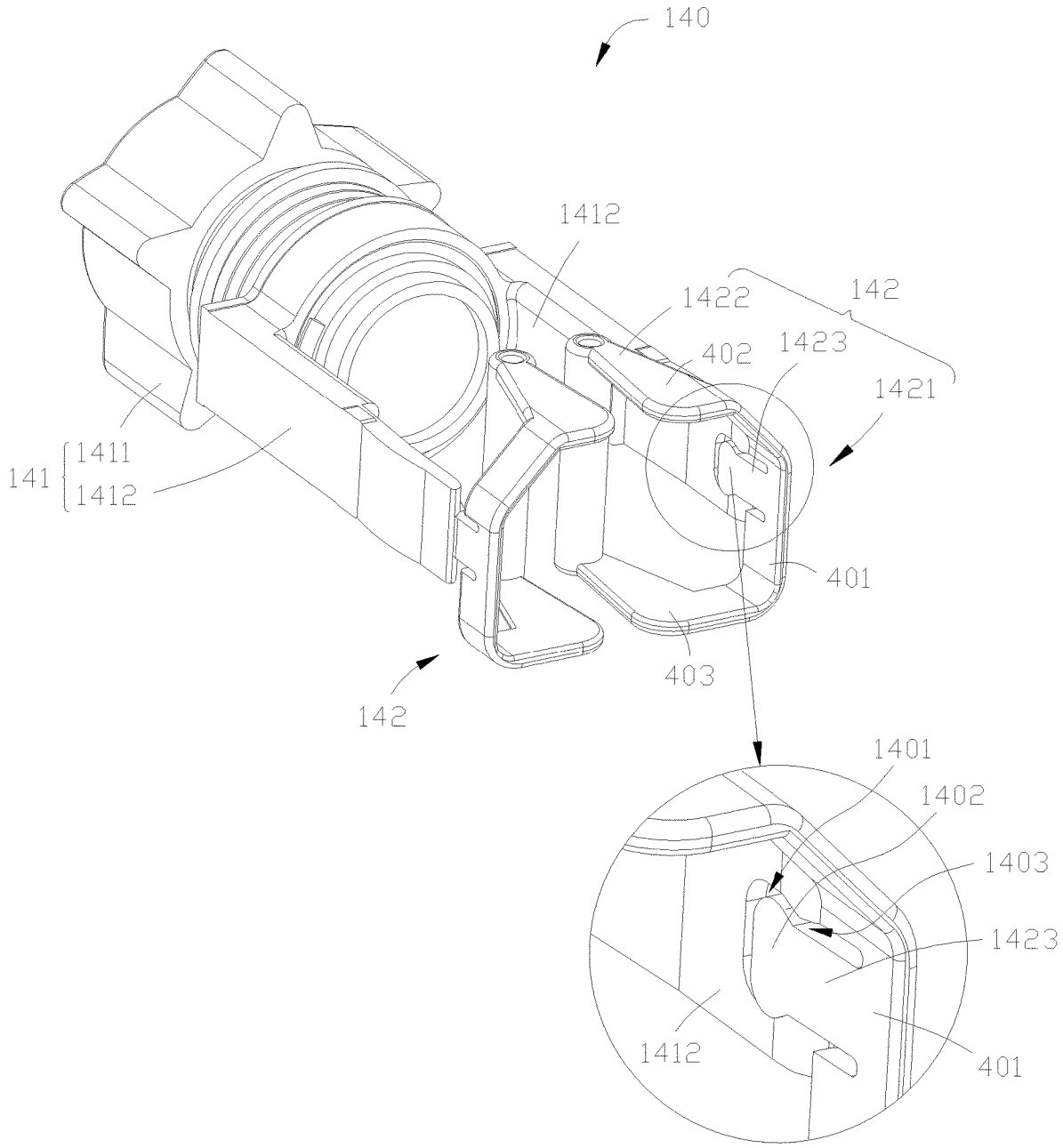
FIG. 3 is a schematic structural view of a locking assembly according to an embodiment of the present disclosure.

As shown in FIG. 3, the locking assembly 140 includes an actuating assembly 141 and a locking member 142. The locking member 142 may include an anti-slip strip disposed on a surface in contact with the first housing 210. The locking member 142 can be rotatably coupled to the second housing 110 via a rotating shaft, and the locking member 142 can be driven to rotate by the actuating assembly 141. During the rotation, the pressure between the locking member 142 and the first housing 210 is gradually increased (refer to FIGS. 4 and 5 at the same time), and the frictional force is accordingly increased. When the frictional force reaches the desired value and the locking electrical connector 100 and/or the outlet connector 200 are difficult to separate the two by pulling, the operation of the actuating assembly 141 can be stopped. When the lock state is required to be released, the actuating assembly 141 is reversed operation, so that the locking member 142 is rotated in the opposite direction and the friction is reduced until the two can be separated.

In an embodiment, the actuating assembly 141 includes an actuating member 1411 and a transmission member 1412. The actuating member 1411 is partially located within the second housing 110. The transmission member 1412 is configured to move only along the axial direction of the second housing 110. The portion of the actuating member 1411 that is located outside the second housing 110 can be operated, so as to move the transmission member 1412 axially. In the present embodiment, the portion of the actuating member 1411 located outside the second housing 110 is configured as a locking screw. The periphery of the portion located inside the second housing 110 is provided with threads. One end of the transmission member 1412 is connected with the threads, the locking screw is operated to rotate the actuating member 1411, and the transmission member 1412 moves along the axial direction of the insertion opening 112 or away from the insertion opening 112.

In order to enable the first housing 210 to be stably locked with the second housing 110, the number of the locking members 142 may be two, and the two locking members 142 are symmetrically disposed on the left and right. Meanwhile, the two locking members 142 can be simultaneously driven to rotate by the actuating assembly 141 to achieve simultaneous frictional locking with the first housing 210 or simultaneous unlocking with the first housing 210.

The locking member 142 can be made of a material having deformation properties. The locking member 142 may include a locking portion 1421, a connecting portion 1422, and a transmission portion 1423.

The locking portion 1421 includes an intermediate section 401, and a first edge 402 and a second edge 403 connected at both ends of the intermediate section 401. The first edge 402 and the second edge 403 may be set facing to each other, resulting the locking portion 1421 is substantially C-shaped. The first edge 402 and the second edge 403 may be respectively connected to the connecting portion 1422. The connecting portion 1422 includes a rotating shaft or a rotating hole. If the locking portion 1421 is substantially C-shaped, the transmission portion 1423 can be substantially connected at the intermediate section 401 of the locking portion 1421.

The transmission portion 1423 is connected to the locking portion 1421 and the actuating assembly 141, and the connection portion 1422 is connected to the second housing 110. The transmission member 1412 is provided with a slot 1401, and the transmission portion 1423 is limited in the slot 1401. Specifically, a notch 1403 is formed on the slot 1401 close to the direction of the insertion slot 112. The transmission portion 1423 includes a limiting block 1402 at the end. The limiting block 1402 is received in the slot 1401, and the transmission portion 1423 can slide in the notch 1403. When the transmission member 1412 moves axially, the limiting block 1402 moves in the slot 1401 and can not disengaged from the slot 1401, and the transmission portion 1423 can slide in the notch 1403 and be properly disengaged for a displacement.

Figure 4:
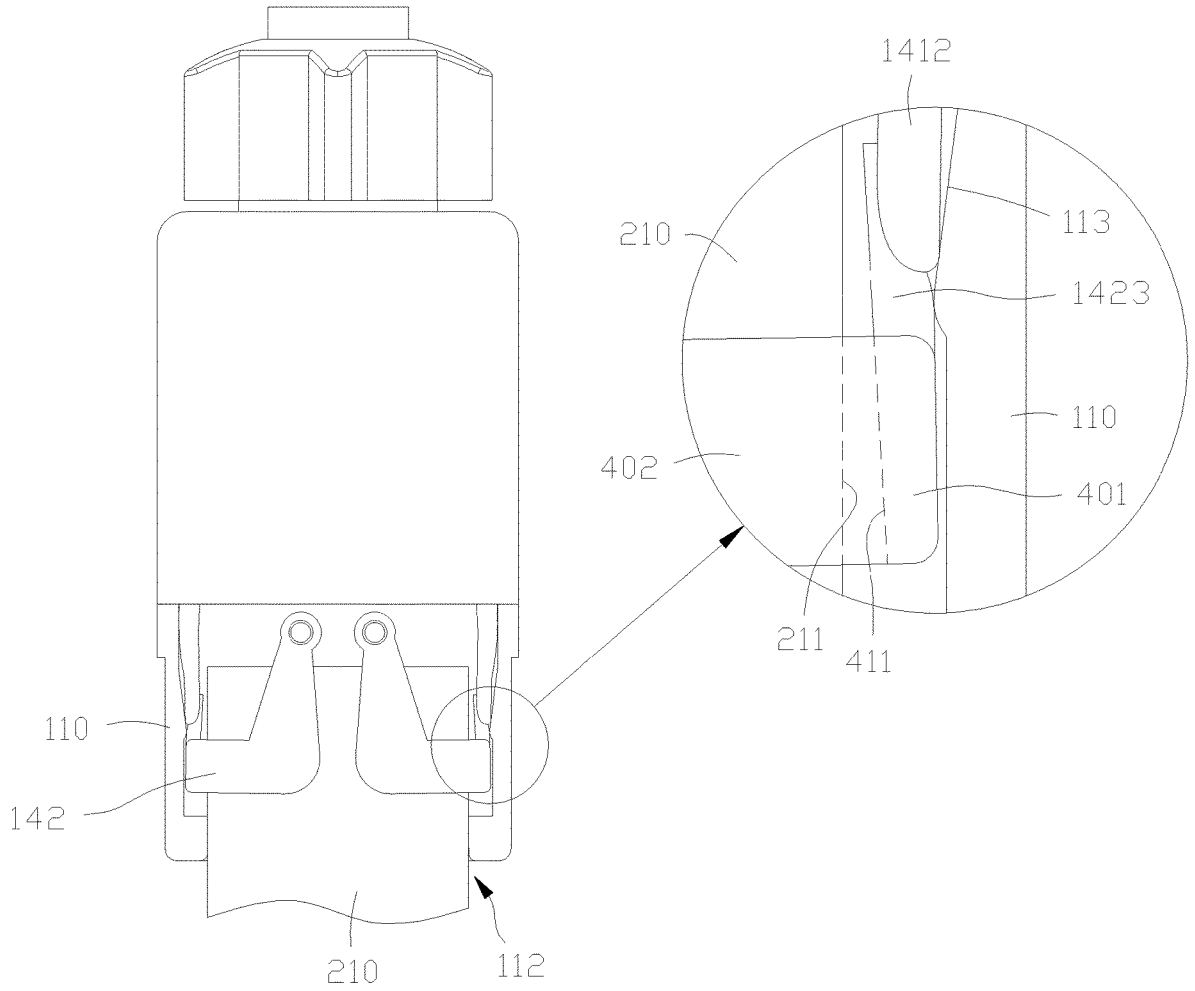
FIG. 4 is a schematic structural view showing the intermediate section unlocked with the first housing according to an embodiment of the present disclosure.
Figure 5:
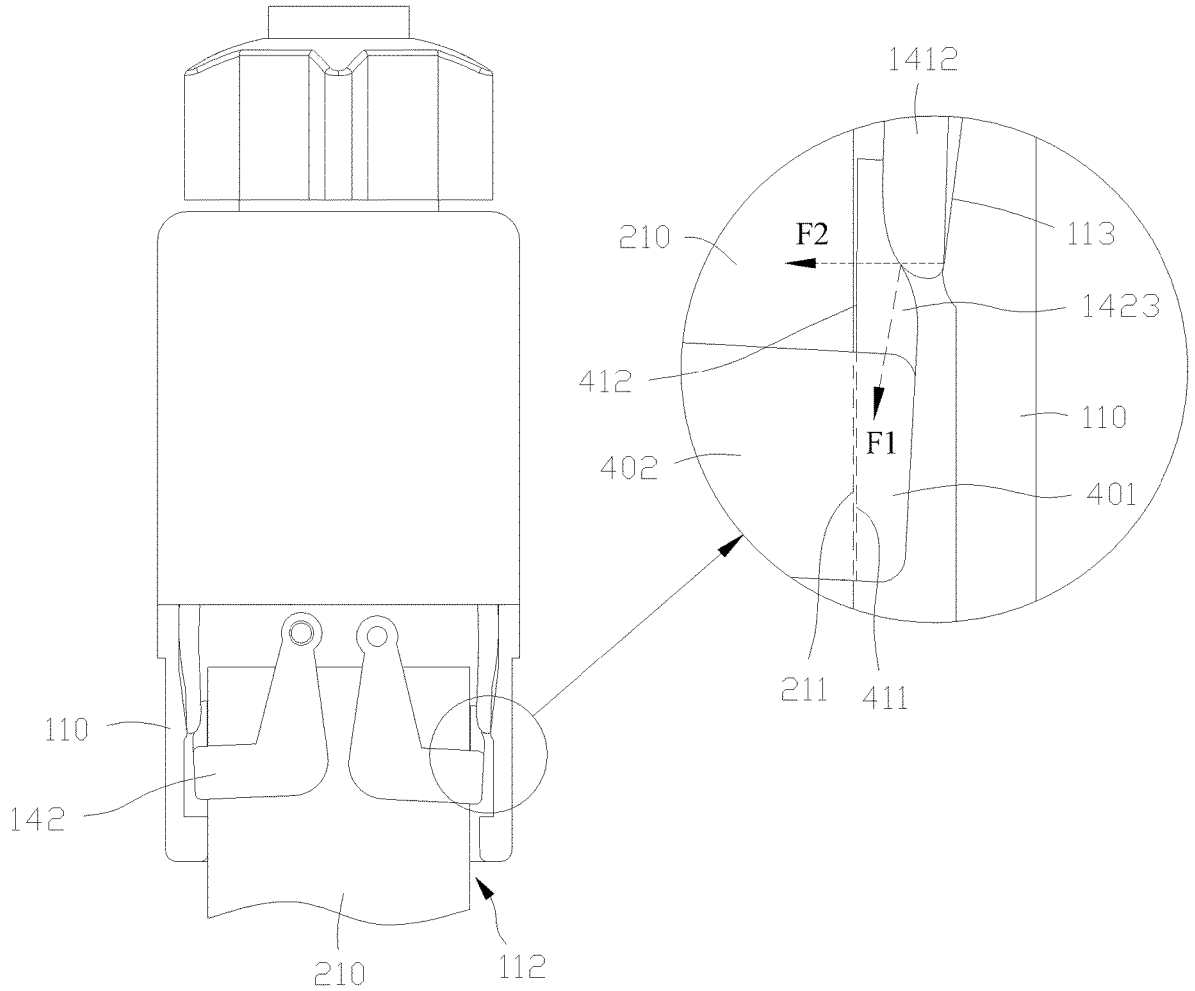
FIG. 5 is a schematic structural view showing the intermediate section locked with the first housing according to an embodiment of the present disclosure.

Wherein, as shown in FIG. 4, the inner surface 411 of the intermediate section 401 is an inclined surface in the non-locking state, that is, not parallel to the corresponding surface 211 of the second housing 210. As shown in FIG. 5, when the locking member 142 is rotated to frictionally lock with the first housing 210, the inner surface 411 of the intermediate section 401 becomes a surface parallel to the corresponding surface 211 of the first housing 210, such that the inner surface 411 of the intermediate section 401 is substantially frictionally integrally locked with the first housing 210 when locked, and the contact area is larger, so that the locking force is greater.

As shown in FIGS. 4 and 5, a portion of the inner side wall of the second housing 110 faces towards a direction of the insertion opening 112 and gradually protrudes towards a center of the inner cavity of the second housing 110 to form a first slope 113. The surface of the first slope 113 may be a flat plane or a curved surface. According to the quantity the locking member 142, the same quantity r of first slopes 113 are provided, and the first slope 113 may be parallel to the rotation axis of the locking member 142. Therefore, the surface of the first slope 113 may serve as a movement rail of the locking member 142 and/or the actuating assembly 141, such that the locking member 142 can be easily rotated, and the first slope 113 can cause the end of the transmission member 1412 of the actuating assembly 141 to give the transmission portion 1423 a pressure F1 obliquely to the first housing 210, so that the intermediate section 401 is then pressed against the first housing 210 and is reliably frictionally locked with the first housing 210. Preferably, when the locking member 142 is frictionally locked with the first housing 210, the first slope 113 can give a pressure F2 to the transmission member 1412 or directly to the transmission portion 1423, such that one end of the transmission portion 1423 which is away from the insertion opening 112 is frictionally locked with the first housing 210. Thus, not only the locking portion 1421 can be frictionally locked with the first housing 210, but also the end of the transmission member 1412 which is away from the insertion opening 112 can be frictionally locked with the first housing 210. Since the locking point is increased, the locking force is increased, and the locking electrical connector 100 and the outlet connector 200 are more difficult to separate.

The inner surface 412 of the transmission portion 1423 is an inclined plane. When the locking member 142 is rotated to an angle that is frictional locked with the first housing 210, the inner surface 412 of the transmission portion 1423 gradually tends to be pressed in parallel with the corresponding surface of the first housing 210. At this moment, all the inner surface 412 of the transmission portion 1423 is substantially frictionally locked with the first housing 210, and the locking area can be further increased.

Figure 6:
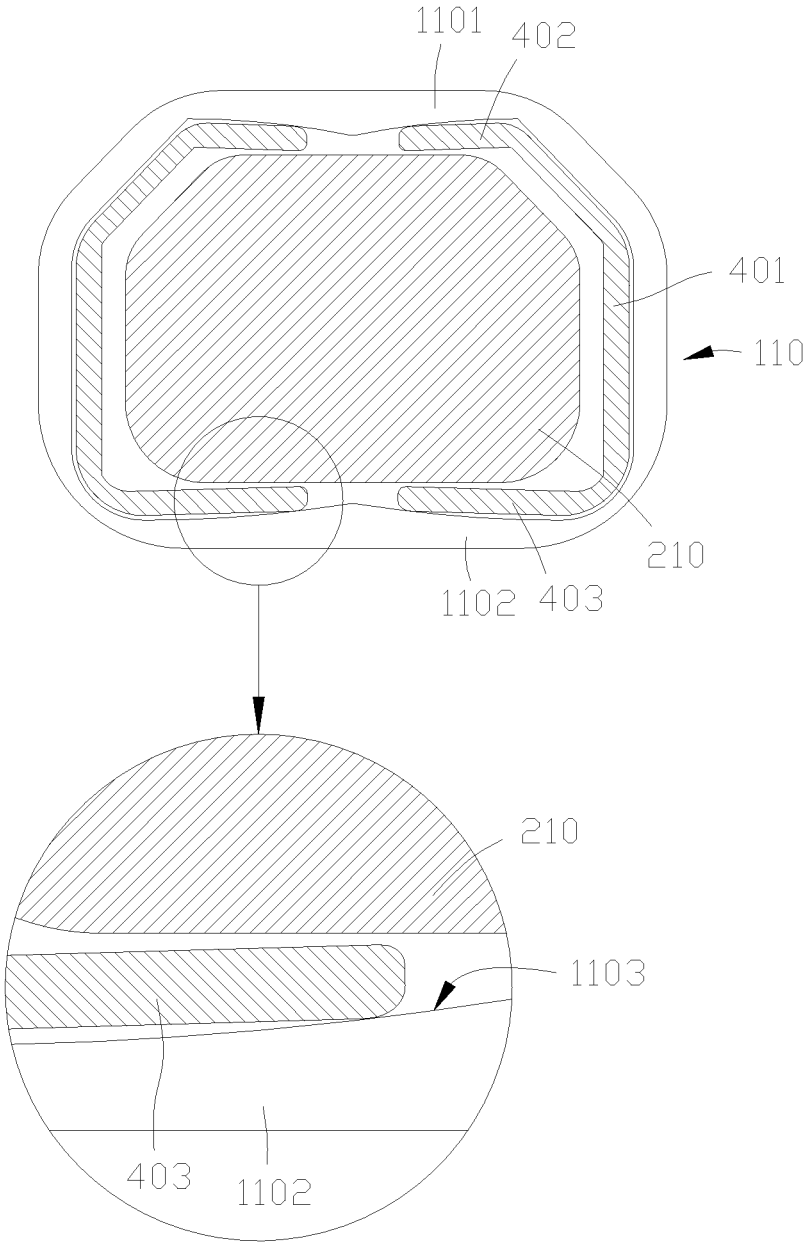
FIG. 6 is a schematic structural view showing an edge unlock with the first housing according to an embodiment of the present disclosure.
Figure 7:
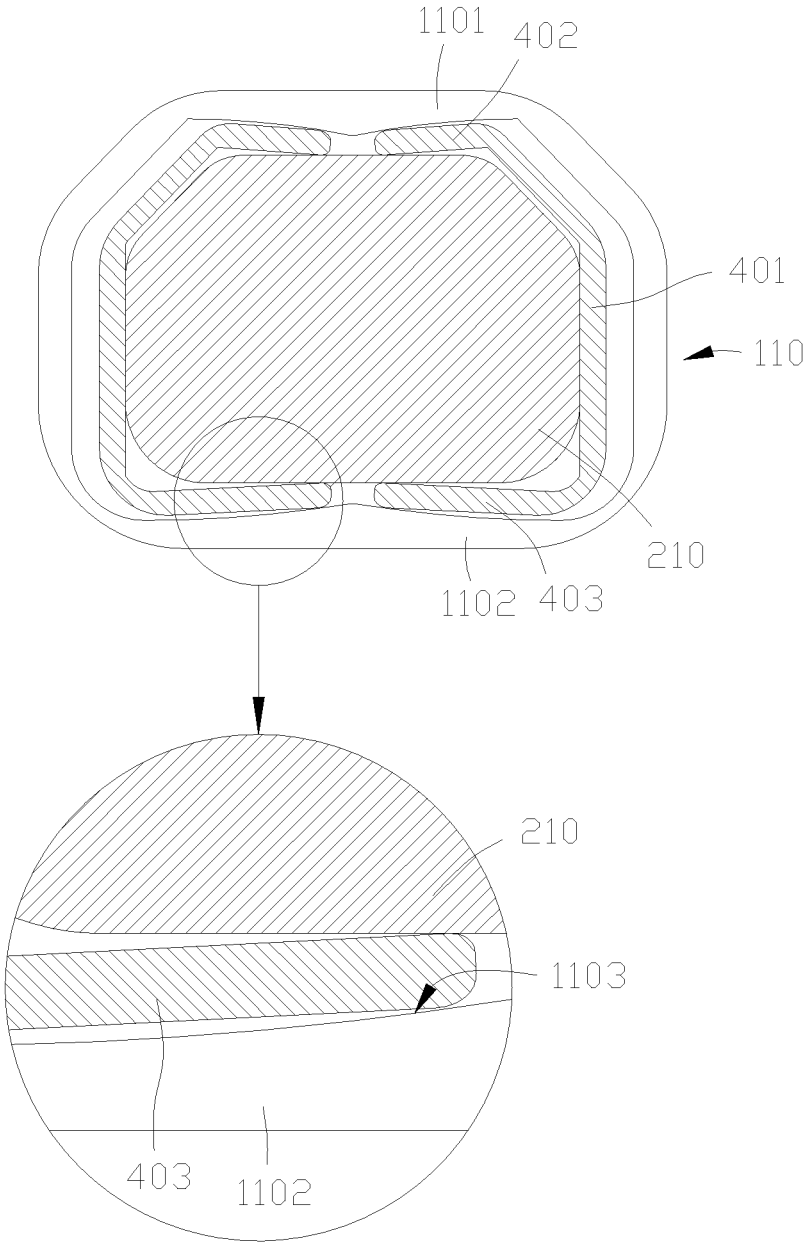
FIG. 7 is a schematic structural view showing an edge lock with the first housing according to an embodiment of the present disclosure.

As shown in FIGS. 6 and 7, a second slope 1103 is formed on the top wall 1101 and/or the bottom wall 1102 of the second housing 110 corresponding to the first edge 402 and/or the second edge 403, and the second slope 1103 may be formed by the central portion of the top wall 1101 and/or the bottom portion 1102 recessing toward both sides. When the locking member 142 is rotated in the locking direction, the first edge 402 and/or the second edge 403 gradually approach the center of the receiving cavity. The surface of the second slope 1103 provides a movement rail for movement of the first edge 402 and/or the second edge 403, the first edge 402 and/or the second edge 403 are gradually deformed under the pressing of the second slope 1103, such that the pressure between the first edge 402 and/or the second edge 403 and the first housing 210 gradually increases, and the friction gradually increased. Therefore, the locking area is increased and the locking pressure is enhanced, and the locking effect is further improved.

The electrical connector 100 can be applied to an electrical connection of a device. The device can be an appliance (e.g., a household appliance) and a converter (e.g., a data converter).

The above description is only the preferred embodiment of the present disclosure, and is not intended to limit the present disclosure. Any modifications, equivalent substitutions and improvements made within the spirit and principles of the present disclosure should be included in the scope of the present disclosure.

The invention claimed is:

1. A locking electrical connector, configured to electrically connect to an outlet connector, the outlet connector having a first housing, the locking electrical connector comprising:

a second housing, at least one electrical connection point being electrically connectable to the outlet connector is received in the second housing;

an actuating assembly;

wherein the locking electrical connector further comprises:

a locking member, rotatably fixed to the second housing and driven by the actuating assembly, so as to rotate relative to the second housing, such that the locking member is frictionally locked with the side surface of the first housing, to realize lock of the electrical connection between the locking electrical connector and the outlet connector; wherein at least a portion of an inner side wall of the second housing gradually protrudes towards a center of an inner cavity of the second housing to form a first slope; during a locking process, at least a portion of the locking member and/or the actuating assembly is capable of acting with the first slope to make a rotation of the locking member more smoothly.

2. The locking electrical connector according to claim 1, wherein the locking member comprises an anti-slip strip disposed on a surface in contact with the first housing.

3. A device, wherein the device uses the locking electrical connector of claim 1.

4. The locking electrical connector according to claim 1, wherein the first housing is inserted from an insertion opening of the second housing and received in the second housing; when locking, the locking member holds an outer surface of the first housing.

5. The locking electrical connector according to claim 4, wherein the actuating assembly comprises an actuating member and a transmission member; the locking member comprises a transmission portion, the transmission member is provided with a slot, the transmission portion is limited in the slot.

6. The locking electrical connector according to claim 5, wherein the actuating member is threadedly connected to the transmission member, such that a rotation motion of the actuating member transforms into linear motion of the transmission member.

7. The locking electrical connector according to claim 5, wherein the first slope directly or indirectly acts on the transmission portion when locked, to make at least one end of the transmission portion frictionally locked with the first housing.

8. The locking electrical connector according to claim 7, wherein an inner surface of the transmission portion is an inclined plane, the inner surface of the transmission portion is substantially integrally frictionally locked with the first housing when locked.

9. The locking electrical connector according to claim 4, wherein at least a portion of the inner side wall of the second housing protrudes to form a second slope; when the locking member rotates to lock, an edge portion of the locking member is pressed by the second slope to frictionally lock with the first housing.

10. The locking electrical connector of claim 9, wherein the locking member comprises a substantially C-shaped locking portion.

11. The locking electrical connector according to claim 10, wherein a surface of the locking member that is parallel to a rotational axis of the locking member is substantially integrally frictionally locked with the first housing when locked.

12. A locking method for locking an electrical connector, for locking electrical connection between a locking electrical connector and an outlet connector, wherein the outlet connector comprises a first housing, the method comprising providing a second housing and an actuating assembly, at least one electrical connection point being electrically connectable to the outlet connector is received in the second housing;

the method further comprising:

providing a locking member, wherein the locking member is rotatably fixed to the second housing and is driven by the actuating assembly, so as to rotate relative to the second housing, such that the locking member is frictionally locked with the side surface of the first housing, to realize lock of the electrical connection between the locking electrical connector and the outlet connector; wherein at least a portion of an inner side wall of the second housing gradually protrudes towards a center of an inner cavity of the second housing to form a first slope; during a locking process, at least a portion of the locking member and/or the actuating assembly is capable of acting with the first slope to make a rotation of the locking member more smoothly;

operating the actuating assembly to rotate the locking member until the locking electrical connector is engageable with the outlet connector and to achieve an electrical connection;

operating the actuating assembly to rotate the locking member until the locking member is frictionally locked with the side surface of the first housing.

* * * * *